US005884558A

United States Patent [19]

Nakamura et al.

[11] Patent Number: 5,884,558

[45] Date of Patent: Mar. 23, 1999

[54] DAMPENING DEVICE FOR PRINTING PRESS

[75] Inventors: Daisuke Nakamura, Kanagawa; Kinichiroh Ohno, Machida, both of Japan

[73] Assignee: Kabushiki Kaisha Tokyo Kikai, Seisakusho, Japan

[21] Appl. No.: 895,236

[22] Filed: Jul. 16, 1997

[30] Foreign Application Priority Data

Oct. 8, 1989 [JP] Japan ..... 8-267089

[51] Int. Cl.[6] ..... B41F 7/30; B41F 31/08

[52] U.S. Cl. ..... 101/148; 101/366

[58] Field of Search ..... 101/148, 147, 101/366, 350.1, 363; 118/674, 683, 313, 315

[56] References Cited

U.S. PATENT DOCUMENTS 4,570,538 2/1986 Webb ..... 101/148
4,815,375 3/1989 Switall et al. ..... 101/148
5,505,126 4/1996 Ohno et al. ..... 101/147

FOREIGN PATENT DOCUMENTS 51-59511 5/1976 Japan .
1-110146 4/1989 Japan .
5-330009 12/1994 Japan .

*Primary Examiner*—J. Reed Fisher
*Attorney, Agent, or Firm*—Rader, Fishman & Grauer; Ronald P. Kananen

[57] ABSTRACT

A dampening device for supplying a dampening liquid to a plate of a printing press is capable of optimize amount of the dampening liquid to be supplied to the plate through a transfer roller irrespective of fluctuation of supply amount of the dampening liquid from the dampening liquid source. The dampening device thus adjusts deposition pattern of the dampening liquid ejected from a plurality of nozzles onto the transfer rollers depending upon a printing speed of the printing press.

6 Claims, 3 Drawing Sheets

DAMPENING DEVICE FOR PRINTING PRESS

BACKGROUND OF THE INVENTION

1. Field of the Invention

The present invention relates generally to a dampening device for a lithographic press. More specifically, the invention relates to a nozzle type dampening device which has a nozzle means ejecting a dampening liquid toward a roller.

2. Description of the Related Art

A lithography employs a substantially flat plate, in which hydrophobic property is provided for an image portion and hydrophilic property is provided for a non-image portion. On the surface of such plate, a water base dampening liquid and an oil base ink are supplied. Then, due to mutual repulsion between the dampening liquid and the ink, only ink can be supplied to the image portion. In order to supply the dampening liquid, a dampening device is employed. The dampening device has generally two kinds of mechanisms.

In one kind of the mechanism to be employed in the dampening device, a roller train from a dampening liquid storage portion to the plate surface is provided. By a peripheral surface of a rotating roller partly dipped within the dampening liquid in the dampening liquid storage portion, the dampening liquid is carried from the dampening liquid storage portion. The dampening liquid thus carried on the peripheral surface of roller is then transferred to the peripheral surface of the adjacent next roller which rotates with contacting with the former roller. Thus, the dampening liquid is transferred sequentially through the rollers. As a result, the dampening liquid is applied on the surface of the plate.

In this type of the dampening device, uniform thin layer of dampening liquid can be formed over the entire axial direction of the roller. However, it is difficult to locally vary supply amount of the dampening liquid per respective portions in the axial direction of the roller. Also, through the sequence of the roller train, the ink on the surface of the plate may be transferred to the dampening liquid storage portion to contaminate the dampening liquid.

Another type of the dampening device has been designed for providing a solution for the drawback in the former type of the dampening device. In this type of the dampening device, a supply source of the dampening liquid is separated from the surface of the plate or the roller train reaching the plate surface, and the dampening liquid is filed toward the plate surface or the roller train reaching the plate surface to enable differentiation of the supply amount of the dampening liquid per portions in the axial direction of the roller. Such type of the dampening device includes a nozzle type dampening device ejecting the dampening liquid from the nozzle as disclosed in Japanese Unexamined Patent Publications (Kokai) Nos. Showa 51-59511, Heisei 1-110146, and Heisei 5-330009 and so forth.

The dampening device disclosed in Japanese Unexamined Patent Publication No. Showa 51-59511 is designed to supply respectively adjusted amounts of the dampening liquid to a plurality of nozzles and to supply air by means of a blower to spray the dampening liquid in atomized form by a high velocity air flow.

In the disclosed device, operation of the driving motor is controlled so that a metering pump may be driven at a desired speed corresponding to a speed of the press.

The dampening device disclosed in Japanese Unexamined Patent Publication No. Heisei 1-110146 includes a pump unit for supplying the dampening liquid, a nozzle ejecting the dampening liquid supplied from the pump unit, and a control unit for controlling ejection amount of the dampening liquid from the nozzle depending upon a printing speed of the press.

The ejection amount of the dampening liquid is controlled by adjusting a period to open each of the nozzles at an ejection timing in relation to rotation speed of a plate cylinder of the press, which ejection timing is determined on the basis of a preliminarily set and stored basic value, an adjusting value set by input depending upon the image to be printed with respect to each ejection nozzle and a correction value preliminarily set and stored relative to each printing speed of the press. Namely, in the disclosed device, control is performed so that given amount of ejection of the dampening liquid is effected at predetermined magnitude of angular displacement of the plate cylinder of the press.

It should be noted that, while there is no specific disclosure in Japanese Unexamined Patent Publication No. Heisei 1-110146, in addition to the control set forth above, the ejection amount of the dampening liquid can be controlled by adjusting the ejection period, i.e. a period to keep the nozzle open, or by adjusting the ejection pressure. In the alternative, the ejection amount of the dampening liquid may be controlled by adjusting an open area of the nozzle by means of a shutter member arranged in front of the nozzle.

Japanese Unexamined Patent Publication No. Heisei 5-330009 discloses the dampening device including a speed detecting means for detecting printing speed of the press, a memory storing supply amount of the dampening liquid to be supplied corresponding to a printing condition and the printing speed of the press, an ejection means connected to the dampening liquid source and an air source through piping for ejecting the dampening liquid in the atomized flow by the high velocity air flow toward the plate cylinder or onto the peripheral surface of the roller contacting with the plate surface, and a pressure control means provided within the piping connecting the dampening liquid source and the ejection means and performing control for the supply pressure of the dampening liquid on the basis of the supply amount of the dampening liquid stored in the memory.

In Japanese Unexamined Patent Publication No. Heisei 5-330009, there is a disclosure that supply amount of the dampening liquid is set corresponding to the printing condition, such as the printing speed, humidity, temperature and so forth, the supply amount of the dampening liquid thus set and the pressure value in the piping downstream of the pressure control means for regulating the pressure of the dampening liquid to be ejected at the downstream side of the pressure control means to control the ejection amount of the dampening liquid, in the shown dampening device. Furthermore, a needle valve is provided at the upstream side of the nozzle per each nozzle. The needle valve serves for fine adjustment of the supply amount of the dampening liquid. By fine adjustment, ability of constant amount supply of the dampening liquid can be improved.

On the other hand, it has been confirmed that the nozzle to be used in the nozzle type dampening device tends to slightly vary spreading angle of the dampening liquid ejected through the nozzle depending upon the supply pressure of the dampening liquid.

In general, the amount of fluid (dampening liquid) to be ejected through the nozzle is not uniform over the entire distribution area. It is typical that the amount of the dampening liquid becomes smaller in the vicinity of the circumferential portion of the distributing region. Accordingly, in the conventional nozzle type dampening device in the printing press, interval of the nozzles and distance between the nozzle and the target to which the dampening liquid is to be ejected are set so that the distributing regions of adjacent nozzles can slightly overlap in the width direction of the plate or in the axial direction of the roller so that the shorting amount of the dampening liquid at the peripheral portions of the distributing regions can be mutually compensated by overlap of the distributing regions.

However, through various printing tests utilizing such nozzle type dampening device, while the reason is not completely clear, it has been found that even though the supply amount of the dampening liquid is adjusted depending upon the printing condition, the amount of the dampening liquid becomes excessive at the portion of the printing surface corresponding to the overlapping portion of the distributing region of the dampening liquid.

SUMMARY OF THE INVENTION

The present invention has been worked out in view of the problem set forth above. Therefore, it is an object of the present invention to provide a dampening device of a printing press which can eliminate the problem that an amount of a dampening liquid becomes excessive at the portion of a printing surface corresponding to a overlapping portion of a distributing region of the dampening liquid in an axial direction of a liquid receiving roller.

According to the first aspect of the present invention, a dampening device for a printing press comprises:

- roller means including one or more liquid reception rollers and having contacting portion with a plate, for transferring a dampening liquid;
- nozzle means provided with a plurality of nozzles arranged substantially in parallel to the axis of the roller in opposition to the outer surface of said liquid reception roller, for ejecting the dampening liquid toward the outer surface of said liquid reception roller;
- dampening liquid supply means for supplying the dampening liquid to said nozzle means under pressure, said dampening liquid supply means including pressure control means for adjusting the pressure at an output side connected to said nozzle means;
- adjusting portion operating means for operating an output side pressure adjusting portion of said pressure control means of said dampening liquid supply means;
- speed signal output means for outputting a speed signal corresponding to a printing speed of the printing press;
- nozzle actuation control means for controlling said nozzle on the basis of a speed signal output from said speed signal output means; and
- dampening liquid supply pressure control means for controlling operation of said adjusting portion operating means on the basis of said speed signal output from said speed signal output means for adjusting the supply pressure of said dampening liquid supplied to said nozzle means at a supply pressure corresponding to the printing speed by adjusting the output side pressure of said pressure control means.

In the dampening device for the printing press, the dampening liquid is fed to the nozzle means from the dampening liquid supply means under pressure. The dampening liquid is then ejected from the nozzle means toward one or more roller means serving as dampening liquid receptacle roller.

The speed signal corresponding to the printing speed of the printing press is output from the speed signal output means. On the basis of the speed signal, the opening of the nozzle is controlled by the nozzle actuation control means. As a result, the dampening liquid can be ejected onto the liquid receptacle roller at predetermined opening condition.

On the other hand, on the basis of the speed signal output from the speed signal output means, the adjusting portion operating means is operated to vary the supply pressure of the dampening liquid to be supplied to the nozzle means under control of the dampening liquid supply pressure control means. Thus, the output side pressure adjusting portion of the pressure control means of the dampening liquid supply means is operated so that the output side pressure of the pressure control means, namely the supply pressure of the dampening liquid to the nozzle means is adjusted to the predetermined pressure corresponding to the printing speed irrespective of the opening condition of the nozzle. Thus, the spread angle of the dampening liquid ejected from the nozzle is varied to the size corresponding to the supply pressure to adjust the distribution of the dampening liquid on the outer periphery of the liquid receptacle roller.

Then, the dampening liquid ejected from respective nozzle is distributed on the outer periphery of the liquid receptacle roller at an optimal amount and an optimal distribution.

The dampening liquid supplied to the outer periphery of the liquid receptacle roller is directly transferred to the plate or to be transferred sequentially to adjacent rollers to finally transferred to the plate.

An ink is also supplied to the plate to form the image with repellent property between the hydrophobic ink to be deposited on the image portion and the hydrophilic dampening liquid to be deposited on the non-image portion. Thus, the ink on the image portion can be transferred to the blanket surface of a blanket cylinder and thus to be printed on a web as the printing medium.

According to the second aspect of the invention, a dampening device for a printing press comprises:

- a source of dampening liquid;
- a roller rotating across a transfer position for transferring a dampening liquid directly or indirectly to a plate;
- a plurality of nozzles arranged in opposition to said roller and aligned along a longitudinal axis of said roller, said nozzles ejecting said dampening liquid toward the opposing surface of said roller under controlled pressure at controlled timing;
- first means for monitoring a printing speed of said printing press for deriving a pressure of said dampening liquid to be supplied to said nozzles corresponding to said printing speed; and
- second means for driving said nozzles in synchronism with rotation of said roller for effecting ejection of the dampening liquid through said nozzles at said controlled timing.

The first means may reduce the pressure of said dampening liquid to be supplied to said nozzle according to increasing of printing speed of said printing press. In such case, the first means varies the pressure of said dampening liquid to be supplied to said nozzle in stepless manner. In the alternative, the first means detects the printing speed of said printing press with respect to a plurality of predetermined printing speed ranges and adjusts the pressure of said dampening liquid to be supplied to said nozzle at pre-set values set with respect to respective of said printing speed ranges.

According to the third aspect of the invention, a dampening device for a printing press comprises:

a source of dampening liquid;

a roller rotating across a transfer position for transferring a dampening liquid directly or indirectly to a plate;

a plurality of nozzles arranged in opposition to said roller and aligned along a longitudinal axis of said roller, said nozzles ejecting said dampening liquid toward the opposing surface of said roller under pressure so that the dampening liquid ejected from each nozzle spread into a predetermined area on the peripheral surface of said roller to form a predetermined distribution pattern of the dampening liquid with combining spread areas of the dampening liquid ejected from respective nozzles and with a predetermined amount of overlap between adjacent spread areas; and overlapping amount adjusting means for monitoring a printing speed of said printing press for deriving an amount of overlap of the spread areas in said predetermined distribution pattern; said overlapping amount adjusting means including pressure control means for controlling pressure of the dampening liquid to be supplied to said nozzle.

The overlapping amount adjusting means may reduce the amount of overlap of the spread areas according to increasing of the printing speed of said printing press. In this case, the overlapping amount adjusting means varies the amount of overlap of the spread areas in inversely proportional to the printing speed of said printing press. In the alternative, the overlapping amount adjusting means detects the printing speed of said printing press with respect to a plurality of predetermined printing speed ranges, and adjusts the amount of overlap of the spread areas at predetermined values set with respect to respective of said predetermined printing speed ranges. To achieve this, in the former case, the overlapping amount adjusting means includes pressure control means for controlling pressure of the dampening liquid to be supplied to said nozzle. In this case, the pressure control means varies the pressure of said dampening liquid to be supplied to said nozzle in stepless manner. In the latter case, then said overlapping amount adjusting means includes pressure control means for controlling pressure of the dampening liquid to be supplied to said nozzle. In this case, the pressure control means adjusts the pressure of the dampening liquid to be supplied to the nozzle at pre-set values set with respect to respective of the printing speed ranges.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Figure 1:
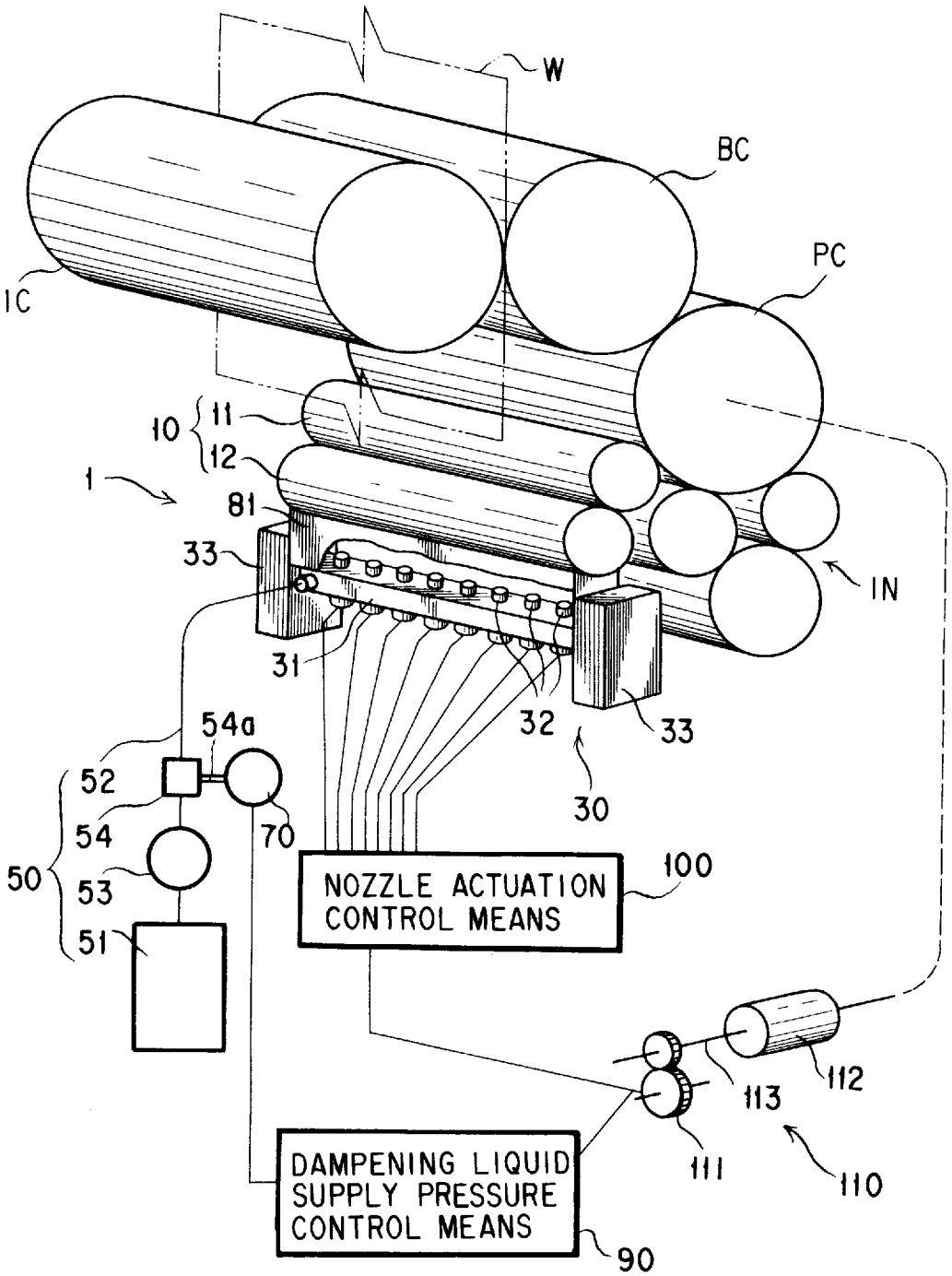
FIG. 1 is a perspective view of the preferred embodiment of a dampening device of a printing press according to the present invention.

In a lithographic press including a dampening device 1, shown in FIG. 1, a plate (not shown), in which hydrophobic property is provided in an image portion and hydrophilic property is provided in a non-image portion, is set on a plate cylinder PC. On a surface of a plate, an appropriate amount of ink is supplied by an inking device IN (in FIG. 1, the upstream side is neglected for convenience of illustration). In conjunction therewith, an appropriate amount of a dampening liquid is supplied by the dampening device 1.

As a result, utilizing opposite physical properties of the image portion and the non-image portion on the surface of the plate and repulsive opposite physical properties of a water base dampening liquid and an oil base ink, the ink is applied only to the image portion. The ink applied on the image portion of the plate is transferred to a blanket (not shown) on a blanket cylinder BC, and then transferred on a web W fed between the blanket cylinder BC and a pressure cylinder IC to print the image on the web W.

In the dampening device 1, a roller means 10 having a contact portion with a plate, a nozzle means 30 for ejecting the dampening liquid toward an appropriate portion of the roller means 10, and a dampening liquid supply means for supplying a dampening liquid to the nozzle means 30.

The roller means 10 includes a downstream roller 11 rotating in contact with the plate and an upstream roller 12 rotating in contact with the downstream roller 11 and serving as a liquid receiving roller receiving the dampening liquid ejected from the nozzle means 30.

While the shown roller means 10 is constructed with two rollers, i.e. the downstream roller 11 and the upstream roller 12, as set forth above, it may be possible to neglect the downstream roller 11 and to directly contact the upstream roller 12 on the plate. In the alternative, a rider roller (not shown) or intermediate roller (not shown) may be added. In the further alternative, reception of the dampening liquid may be performed by outer peripheral surfaces of a plurality of rollers in the vicinity of the adjacent roller. Namely, the liquid reception roller is not limited to one but can be a plural.

The nozzle means 30 is comprises a pipe member 31 provided substantially in parallel to the axis of the upstream roller, and a plurality of (eight in the shown case) nozzles 32, 32, . . . Opposite longitudinal ends of the nozzle means 30 are mounted on a frame (not shown) via brackets 33. To the pipe member 31, a dampening liquid may be supplied from a dampening liquid supply means 50 connected in the manner discussed later, under a pressure.

The nozzles 32, 32, . . . have ejection openings arranged for ejecting the dampening liquid to spread in elliptic distribution with respect to the outer peripheral surface of the upstream roller 12. Each nozzle 32 has an induction opening opening toward the pipe member 31 and an ejection opening directed toward the outer peripheral surface of the upstream roller 12. As set forth above, respective nozzles 32, 32, . . . are arranged so that the dampening liquid may be ejected to form elliptic distribution on the outer peripheral surface of the upstream roller 12. The distance between adjacent nozzles 32, 32, . . . and distance between the nozzles and the outer peripheral surface of the upstream roller are selected so that the distributing region of the dampening liquid ejected from each nozzles are slightly overlapped with the distributing region of the dampening liquid ejected from the adjacent nozzle, and so that the longer axis of the elliptic distribution range of the ejected dampening liquid is substantially parallel to or slightly oblique to the axis of the upstream roller 12.

In the nozzle 32, an electromagnetic valve mechanism (not shown) is provided for controlling supply amount of the dampening liquid from the nozzle 32 by opening and closing of the ejection opening, by opening the ejection opening with exciting a solenoid (not shown) and closing the ejection opening by extinction of excitation of solenoid and by a spring (not shown) under control of a nozzle actuation control means 100 which will be discussed later.

A dampening liquid supply means 50 includes a dampening liquid tank 51 storing the dampening liquid, a pipe passage 52 connecting the dampening liquid tank 51 and the pipe member 31, and a pump 53 disposed in the pipe passage 52. The dampening liquid supply means 50 also includes a pressure control means 54 at downstream side of the pump 53 in the pipe passage 52. On an output side pressure adjusting portion 54*a* of the pressure control means 54, an adjusting portion operating means 70, which will be discussed later, is associated.

It is desirable that the pipe passage 52 is formed with a flexible pipe member at least in the vicinity of the coupling portion with the pipe member 31 so as to facilitate adjustment of mounting position and maintenance.

The adjusting portion operating means 70 is cooperated with the output side pressure adjusting portion 54*a* of the pressure control means 54 is constructed with a driving body 71 as a reversible motor with a reduction gear unit, and a driving side transmission body 72 as a gear mounted on the output shaft of the driving body 71. The driving side transmission body 72 is cooperably coupled with a gear, as an adjusting side transmission body 55, mounted on the output side pressure adjusting portion 54*a* as the rotary operation shaft of the pressure control means 54 directly or via an intermediate power transmission body (not shown). Accordingly, by actuation of the driving body, the output side pressure adjusting portion 54*a* of the pressure control means 54 is rotatingly operated (see FIG. 2).

On the other hand, the shown embodiment is provided with dampening liquid supply pressure control means 90, in which supply pressure of the dampening liquid to the nozzle means 30 is controlled via the pressure control means 54 and the nozzle actuation control means 100 controlling supply amount of the dampening liquid from the nozzle by controlling opening and closing of the ejection opening.

The dampening liquid supply pressure control means 90 and the nozzle actuation control means are electrically cooperated with speed signal output means 110 outputting a signal corresponding to a printing speed of the printing press. The speed signal output means 110 is constructed with a pulse output mechanism 111, such as a rotary encoder, which is cooperated with plate cylinder PC or a rotary portion in synchronism therewith, for example a primary drive shaft 113 driven to rotate by a primary driving source 112.

Figure 2:
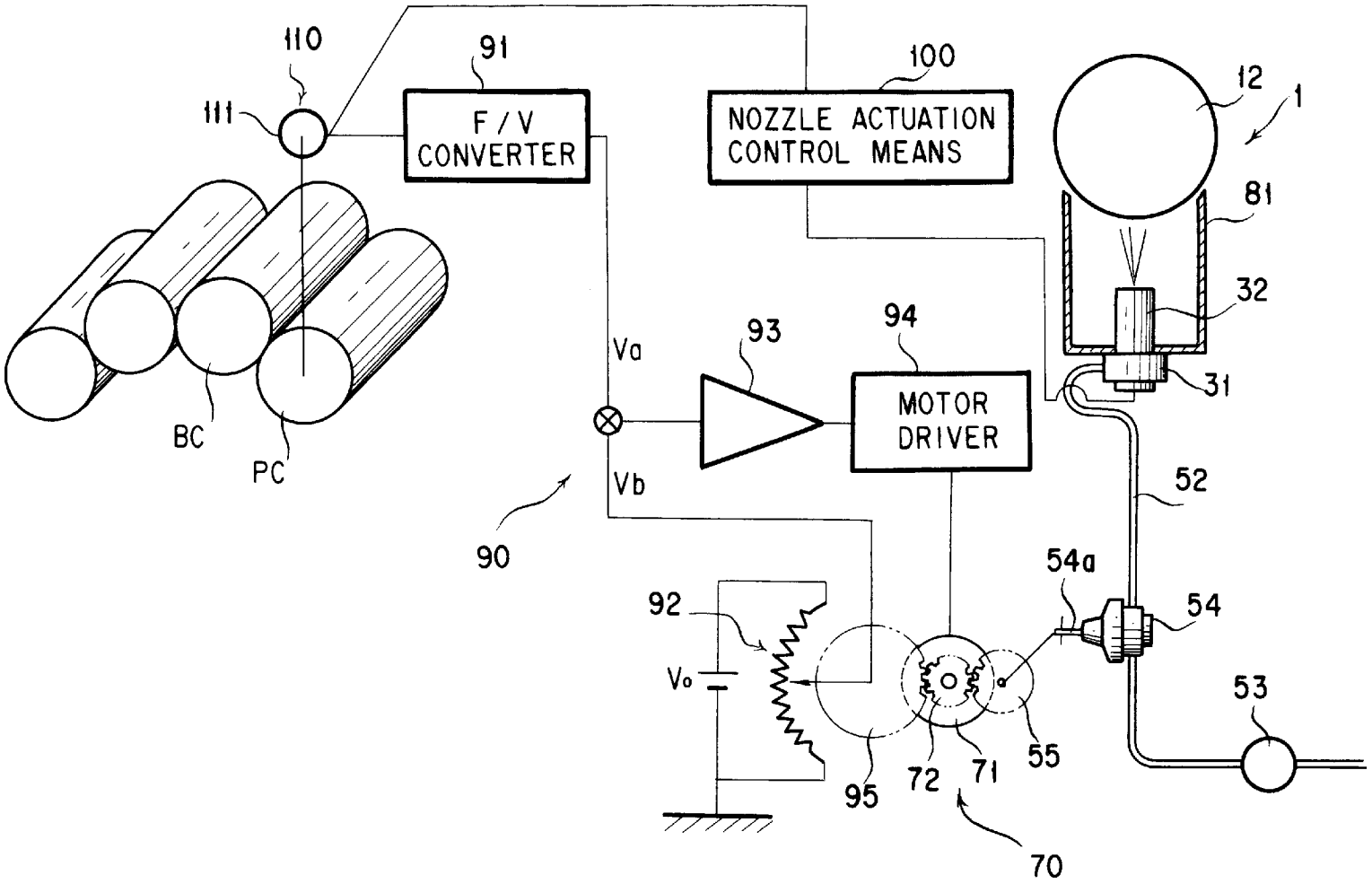
FIG. 2 is a diagrammatic illustration showing one embodiment of a dampening liquid supply pressure control means in the preferred embodiment of the dampening device of the printing press according to the invention.

In the dampening liquid supply pressure control means 90, an F/V converter 91 is connected so that the pulse signal is input from the pulse output mechanism 111 to output a printing speed voltage Va as a voltage corresponding to the pulse signal (see FIG. 2).

On the other hand, to the dampening liquid supply pressure control means 90, a potentiometer 92 is provided. The potentiometer 92 is applied a set voltage Vo and has an operation shaft, on which a gear, as a potentiometer side transmission body 95, meshing with the driving side transmission body 72 output on the output shaft of the driving body 71 via an appropriate intermediate transmission body (not shown) or directly.

Accordingly, the output voltage Vb of the potentiometer 92 is in a magnitude corresponding to a rotational phase of the output side pressure adjusting portion 54*a* of the pressure control means 54 operated for adjustment by the adjusting side transmission member 55 cooperated with the driving side transmission body 72, namely the magnitude of the output side pressure of the pressure control means 54. Therefore, the output voltage Vb of the potentiometer is variable depending upon the rotation phase of the output side pressure adjusting portion 54*a* by actuation of the driving body 71 and thus is variable depending upon variation of the supply pressure of the dampening liquid to the nozzle means 30.

Then, a hysteresis amplifier 93 is connected so that a difference between the printing speed voltage Va output from the F/V converter 91 and the voltage Vb fedback from the potentiometer is input and a signal corresponding thereto is output to a motor driver 94. The motor driver 94 is connected to the driving body 71 for driving the latter to rotate in the appropriate direction in response to the output signal from the hysteresis amplifier 93.

The dampening liquid supply pressure control means 90 of FIG. 2, as set forth above, controls the dampening liquid supply pressure depending upon the printing speed of the printing press in stepless fashion. However, it is also possible to divide the printing speed of the printing press into a plurality of printing speed range with the construction from the speed signal output means 110 to the motor driver 94 as illustrated in FIG. 3 so that the supply pressure of the dampening liquid is controlled a respective predetermined pressures at respective of printing speed ranges.

Figure 3:
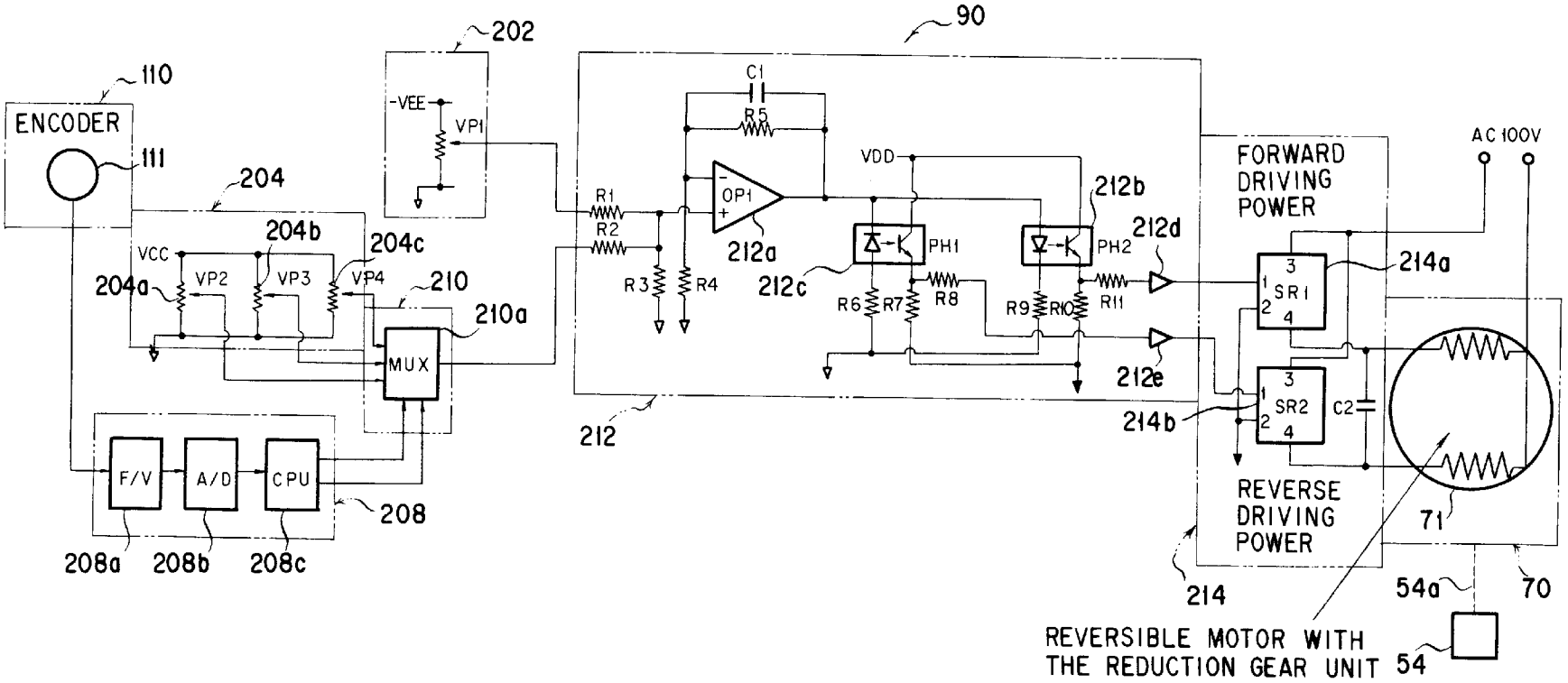
FIG. 3 is a diagrammatic illustration showing another embodiment of a dampening liquid supply pressure control means in the preferred embodiment of the dampening device of the printing press according to the invention.

FIG. 3 shows a construction of another embodiment of the dampening liquid supply pressure control means 90, in which the printing speed of the printing press is divided into several speed ranges and the dampening liquid supply pressure is controlled at predetermined pressure level set for each printing speed range. The shown construction includes an operation shaft (not shown) rotatingly operated together with the output side pressure adjusting portion 54*a* of the pressure control means 54 by the driving body 71 of the adjusting portion operating means 70 similarly to the potentiometer 92 in the dampening liquid supply pressure control means. The dampening liquid supply pressure control means 90 includes a switching means 214, a potentiometer 202 capable of outputting a voltage in a magnitude corresponding to a supply pressure of a dampening liquid to a nozzle means 30, which magnitude corresponds to a magnitude of an output side pressure of the pressure control means 54, a supply pressure setting means 204 for determining a pressure step of the supply pressure of the dampening liquid to the nozzle means 30, data selection signal output means 208 connected to the speed signal output means 110 outputting the signal corresponding to the printing speed of the printing press and outputting a data selection signal corresponding to the printing speed, dampening liquid supply pressure signal output means 210 selecting a voltage value set in the supply pressure setting means in response to the data selection signal for outputting the selected voltage value as a dampening liquid supply pressure signal, and a driving body actuation signal outputting means 212 connected to the potentiometer 202, the dampening liquid supply pressure signal output means 210 and the switch means 214 for summing the output signal of the potentiometer 202 and the output signal of the dampening liquid supply pressure signal output means 210 and whereby outputting an actuation signal of the driving body 71 corresponding to the sum to the switch means 214.

The nozzle actuation control means 100 is so connected as to input the pulse signal from the pulse output mechanism 111 for counting the pulse signal to output an excitation current to solenoids of the nozzles 32, 32, . . . every time where the counted value reaches a predetermined set value. The nozzle actuation control means 100 maintains outputting of the excitation current for a period corresponding to the counted value of the pulses within a unit period, namely the printing speed. The nozzle actuation control means 100 thus includes a solenoid driver and CPU, for example. Control of the excitation current of the nozzles 32, 32, . . . in a form of array is performed per individual nozzle 32.

Next, actuation of the dampening device 1 will be described. By the actuation signal of the dampening device 1, the dampening liquid stored in the dampening liquid tank 51 is supplied to the pipe passage 52 by the pump 53 via the pipe member 31. The supply pressure is adjusted at a predetermined pressure depending upon printing speed by the pressure control means 54. The dampening liquid, as will be discussed later. The dampening liquid fed to the pipe member 31 under pressure is ejected toward appropriate positions on the outer periphery of the upstream roller 12 of the roller means 10 having the contact portion with the plate through the nozzles 32, 32, . . . only when the electromagnetic valve mechanisms of the nozzles 32, 32, . . . are in open position. Then, excess amount of the dampening liquid such as those dripping from the outer periphery of the upstream roller 12, is drained through a not shown drain opening provided in the cover 81 and returned to the dampening liquid tank 51.

On the other hand, the primary driving source 112 is actuated by the actuation signal of the printing press. By this, the primary driving shaft 113 rotatingly driven by the primary driving source 112. The pulse output mechanism 111 outputting the pulse signal depending upon rotation of the primary driving shaft 113 or rotation of the plate cylinder PC.

When the pulse signal output from the pulse output mechanism 111 is input to the nozzle actuation control means 100, the pulse signal is counted by the nozzle actuation control means 100. The nozzle actuation control means 100 outputs excitation signal for the solenoid every time where the counted value of the pulse signal reaches the predetermined set value and maintains the excitation signal for a period depending upon the counted value of the pulse signal within a predetermined unit period, namely the printing speed. The solenoid driver applies excitation current to the solenoids of the electromagnetic valve mechanism of the nozzles 32, 32, . . . according to the excitation signal. As a result, the dampening liquid is ejected in the supply amount according to the predetermined condition for the appropriate portion of the outer surface of the upstream roller 12.

The content of respective setting in valve opening control can be set individually for the nozzles 32, 32, . . . arranged in array in the pipe member 31. Therefore, depending upon proportion and arrangement of the likes on the plate, the dampening liquid is ejected on appropriate position on the outer surface of the upstream roller 12.

The dampening liquid ejected through respective nozzles 32, 32, . . . distributes in elliptic form on the outer periphery of the upstream roller 12. The longer axis of the elliptic distribution of the ejected dampening liquid extends substantially parallel to or in slightly oblique to the longitudinal axis of the upstream roller 12. Mutually adjacent side portion of the elliptic distribution occupies the same region in the axial direction of the upstream roller 12 and the same region in the circumferential direction, or occupies the same region in the axial direction of the upstream roller and the region offset in the circumferential direction so that the dampening liquid mutually compensate for avoiding lacking thereof at the peripheral portion in the circumference of the dampening liquid.

The dampening liquid received by the upstream roller 12 leveled as passing across the contact portion between the upstream roller 12 and the downstream roller 11, and in conjunction therewith transferred to the downstream roller 11. Then, the dampening liquid is transferred from the downstream roller 11 to the plate.

On the plate, an ink is separately supplied from an inking device IN. Due to mutual repellent with the dampening liquid transferred to the non-image portion for hydrophilic property thereof, the ink is transferred only to the image portion having hydrophobic property. The ink on the image portion is printed on a web, i.e. the printing medium, via a blanket surface of the blanket cylinder BC.

On the other hand, when the pulse signal output from the pulse output mechanism 111 is input to the dampening liquid supply pressure control means 90 shown in FIG. 2, the F/V converter 91 in the dampening liquid supply pressure control means 90 outputs the printing speed voltage Va corresponding to number of pulse signal input within a predetermined period, and thus corresponding to the printing speed. On the other hand, the potentiometer 92 outputs a voltage Vb corresponding to the angular phase of the output side pressure adjusting portion 54*a* of the pressure control means, and thus corresponding to the supply pressure of the dampening liquid to the nozzle means as output side pressure of the pressure control means 54.

A voltage signal indicative of a difference between the printing speed voltage Va output from the F/V converter 91 and the voltage Vb fed back from the potentiometer 92 is input to the hysteresis amplifier 93 to be amplified therein and output to the motor driver 94. The motor driver 94 is responsive to the input from the hysteresis amplifier 93 to rotatingly drive the reversible motor with the reduction gear unit as the driving body 71 depending upon polarity and magnitude of the output voltage signal from the hysteresis amplifier 93.

By actuation of the reversible motor with the reduction gear unit as the driving body 71, the output side pressure adjusting portion 54*a* of the pressure control means 54 is driven to cause angular displacement via the adjusting side transmission body 55 to vary supply pressure of the dampening liquid to the nozzle means 30. According to variation of the supply pressure, spread angle of the dampening liquid as ejected through the nozzles 32, 32, . . . is varied to cause variation of the size of the ejected dampening liquid on the peripheral surface of the upstream roller 12.

On the other hand, by actuation of the reversible motor with the reduction gear unit as the driving body 71, the potentiometer 92 is operated to rotate via the driving side transmission body 72 and the potentiometer side transmission body 95 to vary the voltage Vb output from the potentiometer 92.

As a result, the distribution area of the ejected dampening liquid on the outer peripheral surface of the upstream roller 12 is adjusted in a size corresponding to the printing speed.

Thus, the overlapping amount of the distribution area of the ejected dampening liquid in the axial direction of the upstream roller 12 can be adjusted into the predetermined size.

In the shown embodiment, the output side pressure of the pressure control means 54 is controlled in stepless manner corresponding to variation of the printing speed. Namely, according to increasing of the printing speed, the output side pressure is adjusted to be smaller so that the spreading angle of the dampening liquid ejected from the nozzles 32, 32, . . . Thus, overlapping magnitude of the dampening liquid distribution in the axial direction of the upstream roller 12 ejected from respective nozzles 32, 32, . . . becomes smaller.

On the other hand, in the embodiment shown in FIG. 3, the output side pressure of the pressure control means 54 is controlled corresponding to variation of the printing speed in stepwise fashion. Hereinafter, the embodiment shown in FIG. 3 will be discussed in slightly greater detail. The potentiometer 202 is cooperated with the output side pressure adjusting portion 54*a* of the pressure control means 54, similarly to the mechanism shown in FIG. 2, for example. The potentiometer thus outputs a voltage corresponding to the angular phase of the output side pressure adjusting portion 54*a* and a voltage corresponding to the output side pressure of the pressure control means as supply pressure of the dampening liquid to the nozzle means 30.

The supply pressure setting means 204 is constructed with a plurality of (three in the shown example) potentiometers 204*a*, 204*b* and 204*c*. The supply pressure of the dampening liquid to the nozzle means per every predetermined printing speed ranges is set at the voltage value output by the potentiometer 202 and the voltage value having opposite polarity.

The data select signal output means 208 has an F/V converter 208*a*, an A/D converter 208*b*, and a CPU 208*c*. The data select signal output means 208 detects printing speed of the printing press on the basis of the pulse signal synchronous with rotation of the plate cylinder PC from the pulse output mechanism 111 as the speed signal output means 110, and outputs the data select signal corresponding to the detected printing speed.

The dampening liquid supply pressure signal output means 210 comprises an analog multiplexer 210*a* and selects a corresponding voltage value on the basis of the data select signal output from the data select signal output means amount the voltage values preliminarily set in respective potentiometers 204*a*, 204*b* and 204*c* of the supply pressure setting means 204. Then, the dampening liquid supply pressure signal output means 210 outputs the selected voltage value as the dampening liquid supply pressure signal to the driving body actuation signal output means 212.

The driving body actuation signal output means 212 is constructed with an operation amplifier 212*a*, a photocouplers 212*b* and 212*c*, buffers 212*d* and 212*e* and so forth. The driving body actuation output means 212 outputs actuation signal for rotatingly driving the reversible motor with the reduction gear unit as the drive body 71 in either forward or reverse direction via the switch means 214 on the basis of a sum of the voltage values of the output signal of the potentiometer 202 and the dampening liquid supply pressure signal from the dampening liquid supply pressure signal output means 210.

The switch means 214 is constructed with solid-state relay 214*a* and 214*b*. The switch means 214 is disposed between the power source for the motor and the reversible motor with the reduction gear unit as the driving body 71 for turning between a forward drive position to drive the motor in forward direction and a reverse drive position to drive the motor in the reverse direction.

With the construction set forth above, the shown embodiment of FIG. 3 operates as follows. At first, at an appropriate timing in advance of actuation of the printing press or after actuation, respective potentiometers 204*a*, 204*b* and 204*c* of the supply pressure setting means 204 is operated to set the voltage value at which a plurality of necessary supply pressures for the dampening liquid to be supplied to the nozzle means 30. In the embodiment illustrated in FIG. 3, positive voltage value is set.

On the other hand, according to operation of the dampening device 1, the potentiometer 202 outputs the voltage signal having a negative voltage value corresponding to the angular phase of the output side pressure adjusting portion 54*a* of the pressure control means 54 controlling the dampening liquid supply pressure.

According to operation of the printing press, the pulse output mechanism 111 of the speed signal output means 110 outputs the pulse signal in synchronism with rotation of the plate cylinder PC.

The pulse signal is processed by the F/V converter 208*a*, the A/D converter 208*b* and the CPU 208*c* of the data select signal output means 208. Namely, the printing speed of the printing press is calculated. On the basis of the resultant printing speed of the printing press, the data select signal output means 208 outputs the data select signal indicative of the selected voltage value. For example, the data select signal is variable depending upon operation speed X of the printing press, i.e. o copy/hour$\leqq$X<50,000 copies (first level), 50,000 copies$\leqq$X<100,000 copies (second level) and 100,000 copies$\leqq$X (third level).

The data select signal is input to an analog multiplexer 210*a* of the dampening liquid supply pressure signal output means 210. On the other hand, to the analog multiplexer 210*a*, the positive voltage set in respective potentiometer 204*a*, 204*b* and 204*c* of the supply pressure setting means 204 is input.

The analog multiplexer 210*a* of the dampening liquid supply pressure signal output means 210 selects corresponding one of the among the voltage value set in the potentiometer 204*a*, 204*b* and 204*c* depending upon the data select signal to output as the dampening liquid supply pressure signal. Namely, when the printing speed of the printing press is in the first level, the data select signal corresponding to the first level is input to the analog multiplexer 210*a*. Then, in response to the data select signal, the analog multiplexer 210*a* selects the positive voltage set in the potentiometer 204*b* to output the selected positive voltage value as the dampening liquid supply pressure signal.

When the printing speed of the printing press is in the third level, depending upon the data select signal, the analog multiplexer 210*a* selects the positive voltage value set in the potentiometer 204*c* to output as the dampening liquid supply pressure signal of the positive voltage.

The dampening liquid supply pressure signal from the dampening liquid supply pressure signal output signal 210 is added with a negative voltage value output from the potentiometer 202. The voltage value of the sum is input to the operational amplifier 212*a* in the driving body actuation signal output means 212. In the operational amplifier, the input voltage value is amplified to drive the photocouplers 212*b* or 212*c*. Namely, when the input voltage value is the positive voltage value, the output of the operational amplifier 212*a* becomes positive voltage value. Then, the photocoupler 212*b* is driven to output H level through the buffer 212*d*. When the input voltage value is the negative voltage value, the output of the operational amplifier 212*a* becomes negative voltage value. Then, the photocoupler 212*c* is driven to output H level through the buffer 212*e*. Then, the H level signal output through the buffer 212*d* when the photocoupler 212*b* is driven or the H level signal output through the buffer 212*e* when the photocoupler 212*c* is driven, is the signal output from the driving body actuation signal output means 212. It should be noted that light emitting diodes of the photocouplers 212*b* and 212*c* serve as feedback for the operational amplifier 212*a* to prevent the photocouplers 212*b* and 212*c* from being driven simultaneously.

The driving body actuation signal output from the driving body actuation signal output means 211 is input to the solid state relay 214*a* or 214*b* of the switch means 214. One of the solid state relay 214*a* or 214*b* of the switch means 214, to which the driving body actuation signal is input, establishes power supply path between the power source for the motor and the reversible motor with the reduction gear unit as the driving body 71 for driving the latter in forward direction or reverse direction. Namely, when the photocoupler 212*b* is driven and the H level drive body actuation signal is output from the buffer 212*d*, the drive body actuation signal is input to the solid state relay 214*a* to establish a forward driving power supply path between the power source for the motor and the reversible motor with the reduction gear unit as the drive body 71 for driving the latter in the forward direction. On the other hand, when the photocoupler 212*c* is driven and the H level drive body actuation signal is output from the buffer 212*e* the drive body actuation signal is input to the solid state relay 214*b* to establish a reverse driving power supply path between the power source for the motor and the reversible motor with the reduction gear unit as the drive body 71 for driving the latter in the reverse direction.

The dampening device 1 having the dampening liquid supply pressure control means 90 in the embodiment illustrated in FIG. 3 operates substantially the same manner as the dampening device 1 having the dampening liquid supply pressure control means 90 shown in FIG. 2, except for stepwise control of the supply pressure corresponded to the foregoing three levels of the printing speed.

Accordingly, the size of ejected dampening liquid distribution area on the outer periphery of the upstream roller 12 can be adjusted corresponding to the printing speed. Thus, the overlapping magnitude of the ejected dampening liquid distribution on the upstream roller in the axial direction of the upstream roller 12 is adjusted to the predetermined area.

It should be noted that, in the discussion for the preferred embodiments as set forth above, the drive body 71 has been discussed as the reversible motor with the reduction gear unit, any reversible motor may be employed.

As set forth above, with the dampening device for the printing press according to the present invention, the dampening liquid supply pressure for the nozzle means which ejects the dampening liquid, can be varied with no direct relationship with variation of the supply amount of the dampening liquid corresponding to the printing speed. By this, the spreading angle of the dampening liquid ejected from the nozzle can be varied with no direct connection with variation of the supply amount of the dampening liquid and whereby permit to vary the dampening liquid distribution range on the outer periphery of the liquid reception roller so that overlapping magnitude in the axial direction of the liquid reception roller can be controlled automatically due to variation of the supply amount of the dampening liquid.

Accordingly, according to increasing of the printing speed, the size of overlap in the axial direction of the pressure reception, for reducing automatically. Thus, according to present invention, according to increasing of the printing speed, the problem to be encountered by excess amount of the dampening liquid on the printing surface corresponding to the overlapping portion in the axial direction of the liquid reception roller, can be avoided successfully.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. A dampening device for a printing press comprising: roller means including one or more liquid reception rollers and having contacting portion with a plate, for transferring a dampening liquid;

nozzle means provided with a plurality of nozzles arranged substantially in parallel to the axis of the roller in opposition to the outer surface of said liquid reception roller, for ejecting the dampening liquid toward the outer surface of said liquid reception roller;

dampening liquid supply means for supplying the dampening liquid to said nozzle means under pressure, said dampening liquid supply means including pressure control means for adjusting the pressure at an output side connected to said nozzle means;

adjusting portion operating means for operating an output side pressure adjusting portion of said pressure control means of said dampening liquid supply means;

speed signal output means for outputting a speed signal corresponding to a printing speed of the printing press;

nozzle actuation control means for controlling said nozzle means on the basis of a speed signal output from said speed signal output means; and dampening liquid supply pressure control means for controlling operation of said adjusting portion operating means on the basis of said speed signal output from said speed signal output means for adjusting the supply pressure of said dampening liquid supplied to said nozzle means at a supply pressure corresponding to the printing speed by adjusting the output side pressure of said pressure control means in such a manner that said output side pressure of said nozzle means is decreased according to increasing of said printing speed.

2. A dampening device for a printing press comprising:

a source of dampening liquid;

a roller rotating across a transfer position for transferring a dampening liquid directly or indirectly to a plate;

a plurality of nozzles arranged in opposition to said roller and aligned along a longitudinal axis of said roller, said nozzles ejecting said dampening liquid toward the opposing surface of said roller under controlled pressure at controlled timing;

first means for monitoring a printing speed of said printing press for deriving a pressure of said dampening liquid to be supplied to said nozzles corresponding to said printing speed in such a manner, that said output side pressure of said nozzle is decreased according to increasing of said printing speed; and second means for driving said nozzles in synchronism with rotation of said roller for effecting ejection of the dampening liquid through said nozzles at said controlled timing.

3. A dampening device as set forth in claim 2, wherein said first means reduces the pressure of said dampening liquid to be supplied to said nozzle according to increasing of printing speed of said printing press.

4. A dampening device as set forth in claim 3, wherein said first means varies the pressure of said dampening liquid to be supplied to said nozzle in stepless manner.

5. A dampening device as set forth in claim 3, wherein said first means detects the printing speed of said printing press with respect to a plurality of predetermined printing speed ranges and adjusts the pressure of said dampening liquid to be supplied to said nozzle means at pre-set values set with respect to respective of said printing speed ranges.

6. A dampening device for a printing press comprising:

a source of dampening liquid;

a roller rotating across a transfer position for transferring a dampening liquid directly or indirectly to a plate;

a plurality of nozzles arranged in opposition to said roller and aligned along a longitudinal axis of said roller, said nozzles ejecting said dampening liquid toward the opposing surface of said roller under pressure so that the dampening liquid ejected from each nozzle spread into a predetermined area on the peripheral surface of said roller to form a predetermined distribution pattern of the dampening liquid with combining spread areas of the dampening liquid ejected from respective nozzles and with a predetermined amount of overlap between adjacent spread areas; and overlapping amount adjusting means for monitoring a printing speed of said printing press for deriving an amount of overlap of the spread areas in said predetermined distribution pattern for decreasing said spread areas in said predetermined distribution pattern according to increasing of said printing speed; said overlapping amount adjusting means including pressure control means for controlling pressure of the dampening liquid to be supplied to said nozzle for adjusting said distribution pattern.

* * * * *